US005115842A

United States Patent [19]

Crafts et al.

[11] Patent Number: 5,115,842

[45] Date of Patent: May 26, 1992

[54] APPARATUS FOR DELIVERY OF A LIQUID

[75] Inventors: Douglas E. Crafts, San Jose; Mark A. Leonov, Santa Clara, both of Calif.

[73] Assignee: Intel Corporation, Santa Clara, Calif.

[21] Appl. No.: 575,335

[22] Filed: Aug. 30, 1990

[51] Int. Cl.[5] ..... B65B 3/04

[52] U.S. Cl. ..... 141/286; 222/165; 141/113; 141/309; 141/319; 141/363

[58] Field of Search ..... 141/7, 65, 113, 94, 141/95, 198, 285, 286, 309, 319, 363, 364, 365, 366, 775; 222/51, 64, 66, 164, 165, 166, 481

[56] References Cited

U.S. PATENT DOCUMENTS

| | | | |
|---|---|---|---|
| 2,191,918 | 2/1940 | Stadtfeld | 222/165 X |
| 2,388,111 | 10/1945 | Berman | 222/165 |
| 3,147,890 | 9/1964 | Mittelsteadt | 222/165 |
| 3,156,272 | 11/1964 | Indrunas | 141/286 |
| 3,341,073 | 9/1967 | Arps et al. | 222/66 X |
| 4,493,350 | 1/1985 | Beikel et al. | 141/65 |
| 4,874,023 | 10/1989 | Ulm | 141/346 |

OTHER PUBLICATIONS

Specification sheet for the Omron capacitive sensor part number E2K-F10MC sold by Omron Electronics, Inc. of Schaumberg, Ill.

*Primary Examiner*—Ernest G. Cusick

*Attorney, Agent, or Firm*—Blakely, Sokoloff, Taylor & Zafman

[57] ABSTRACT

An apparatus for delivery of a liquid. The apparatus includes a housing and a cradle for holding a container containing the liquid. The cradle is rotatably coupled to the housing. The cradle is rotatable between a first position and a second position. The apparatus further includes a reservoir for receiving the liquid from the container. The reservoir is coupled to the cradle and rotates with the cradle. The reservoir includes a passageway through which the liquid is able to flow downward for all positions the cradle is permitted to rotate to. The reservoir includes a cylinder for minimizing back flow of the liquid from the reservoir to the container. The reservoir also includes a first orifice for allowing the liquid to pass out of the reservoir, a second orifice for allowing an air bubble in the liquid to return to the reservoir, and a check valve for allowing air to pass into the reservoir. The second orifice is at a location higher than the first orifice for all positions between the first and second positions that the cradle is permitted to rotate to.

16 Claims, 5 Drawing Sheets

APPARATUS FOR DELIVERY OF A LIQUID

FIELD OF THE INVENTION

The present invention relates to the field of liquid delivery systems. More particularly, the present invention relates to an apparatus for delivery of liquids, wherein the liquids include chemicals used in semiconductor processing.

BACKGROUND OF THE INVENTION

FIG. 1 illustrates one prior art apparatus 48 used to dispense liquid chemicals for semiconductor manufacturing. Apparatus 48 includes extractor tube 39 that passes through rubber stop 36 and extends into bottle 35. Liquids inside the bottle can be removed through feed tube 38, which is coupled to extractor tube 39 with clamp 37. Liquids can be extracted from bottle 35 by pumping or siphoning.

One disadvantage of apparatus 48 of FIG. 1 is that gap 40 between end 50 of extractor tube 39 and bottom 51 of bottle 35 inhibits the removal of all liquid from bottle 35. When relatively expensive chemicals are used with apparatus 48 as part of a manufacturing process, this loss of liquids can sometimes be costly. Moreover, the disposal of bottles containing even small amounts of certain chemicals sometimes raises environmental concerns.

Another disadvantage of apparatus 48 is that production sometimes must be stopped while bottle 35 is replaced with a bottle containing a new supply of the chemical being used in production.

Another disadvantage of apparatus 48 is that contamination is possible. When tube 38 is removed from bottle 35, extractor tube 39 is sometimes exposed to atmospheric contaminants and other contaminants external to bottle 35. If tube 39 is then placed in a new bottle 35, the contents of new bottle 35 are exposed to the contaminants on tube 39. In addition, once tube 38 is removed from bottle 35, extractor tube 39 may be covered with a residue of the liquid of bottle 35. If extractor tube 39 is then inserted in a different bottle 35 containing a different type of liquid, contamination might occur.

Moreover, the exposure of extractor tube 39 to the atmosphere for a period of time can sometimes lead to the crystallization of residual chemicals on extractor tube 39. The crystals can sometimes contaminate the liquid of new bottle 35. In addition, residues can sometimes clog extractor tube 39 partially or completely. The cleaning of tube 39 can sometimes result in the loss of production time.

One prior art delivery system employs an external probe (not shown) that is inserted into bottle 35 to measure the amount of liquid remaining in bottle 35. Any contaminants on the external probe can also lead to contamination of the liquid of bottle 35.

Another disadvantage of apparatus 48 is that air sometimes enters extractor tube 39 and feed tube 38. The air can cause air bubbles to form in the liquids being dispensed. Air bubbles should be removed from any liquid used in the production process to avoid misapplication of the liquids. Air bubbles are typically removed by running "dummy" or test wafers through the production process a number of times in order to "bleed" the liquid delivery system until air bubbles in the feed lines have been removed. This wastes the chemicals contained within the bottles, and certain chemicals can be relatively costly.

Yet another disadvantage of apparatus 48 is that the replacement of bottle 35 sometimes exposes individuals to hazardous chemicals, which can be a safety problem.

SUMMARY AND OBJECTS OF THE INVENTION

One object of the present invention is to provide an apparatus allowing relatively efficient delivery of liquids.

Another object of the present invention is to provide an apparatus that improves the safety and reliability of liquid delivery.

Another object of the present invention is to provide an apparatus for delivery of liquids in a way that minimizes the chances of atmospheric contamination.

Another object of the present invention is to provide an apparatus allowing additional liquids to be added to a liquid delivery system in a relatively efficient manner.

An apparatus for delivery of a liquid is described. The apparatus includes a housing and a holding means for holding a container containing the liquid. The holding means is rotatably coupled to the housing. The holding means is rotatable between a first position and a second position. The apparatus further includes a dispensing means for receiving the liquid from the container. The dispensing means is coupled to the holding means and rotates with the holding means. The dispensing means includes a passageway through which the liquid is able to flow downward for all positions the holding means is permitted to rotate to. The dispensing means includes a baffling means for minimizing back flow of the liquid from the dispensing means to the container. The dispensing means also includes a first orifice for allowing the liquid to pass out of the dispensing means, a second orifice for allowing an air bubble in the liquid to return to the dispensing means, and a check valve means for allowing air to pass into the dispensing means. The second orifice is at a location higher than the first orifice for all positions the holding means is permitted to rotate to.

Other aspects, objects, features, and advantages of the present invention will be apparent from the accompanying drawings and detailed description that follows.

BRIEF DESCRIPTION OF THE DRAWINGS

The present invention is illustrated by way of example and not limitation in the figures of the accompanying drawings in which like references indicate similar elements and in which.

DETAILED DESCRIPTION

Figure 1:
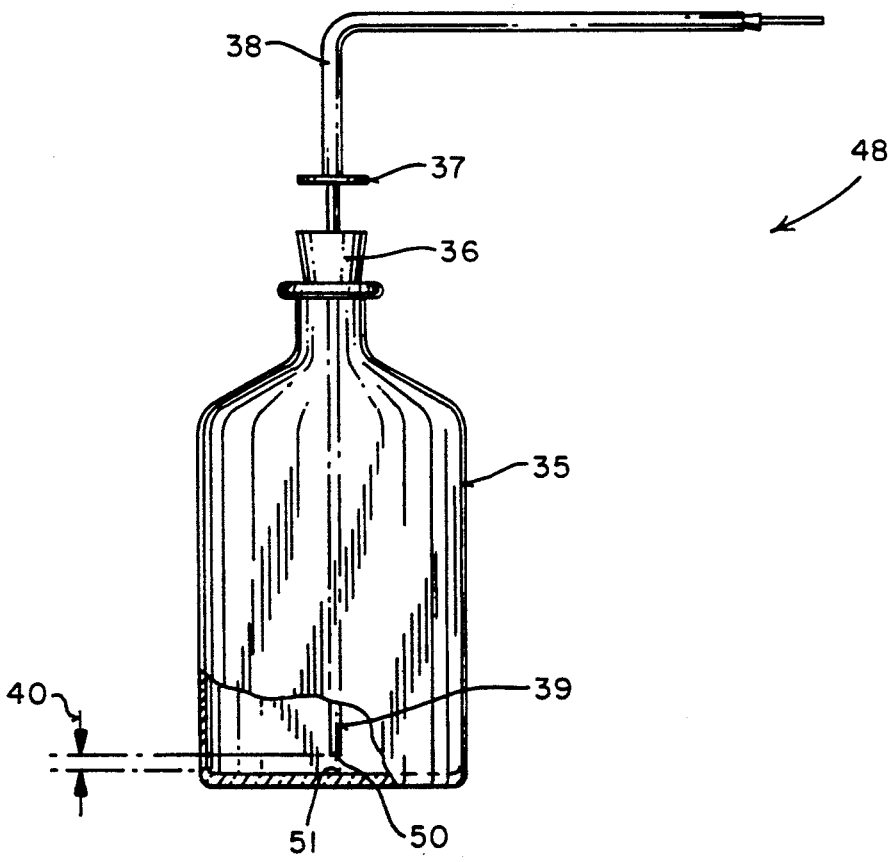
FIG 1 (PRIOR ART)
FIG. 1 shows a prior art chemical dispensing apparatus.
Figure 2A:
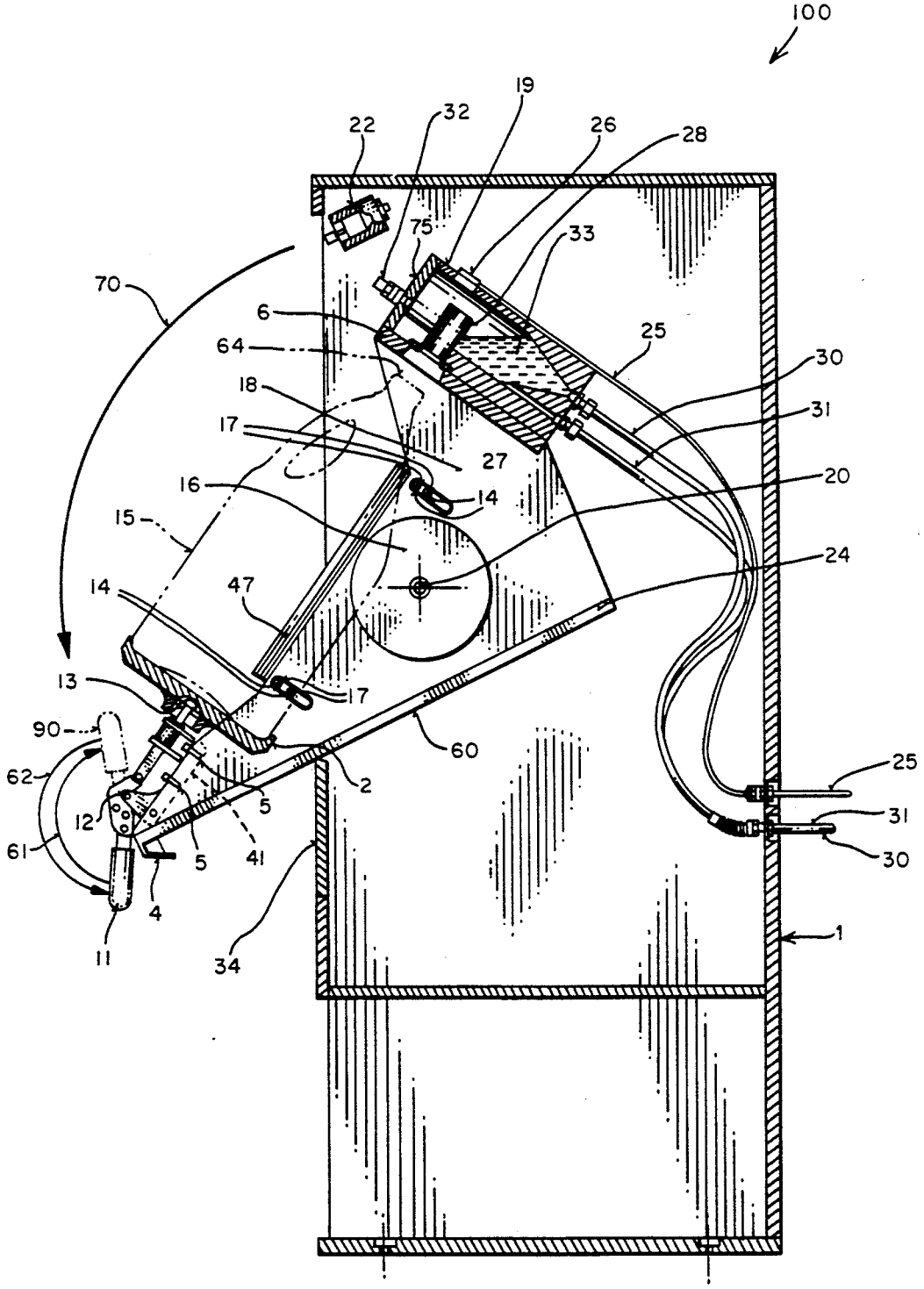
FIG. 2A shows a side cross-sectional view of the liquid delivery apparatus with a bottle cradle in an open position.
Figure 2B:
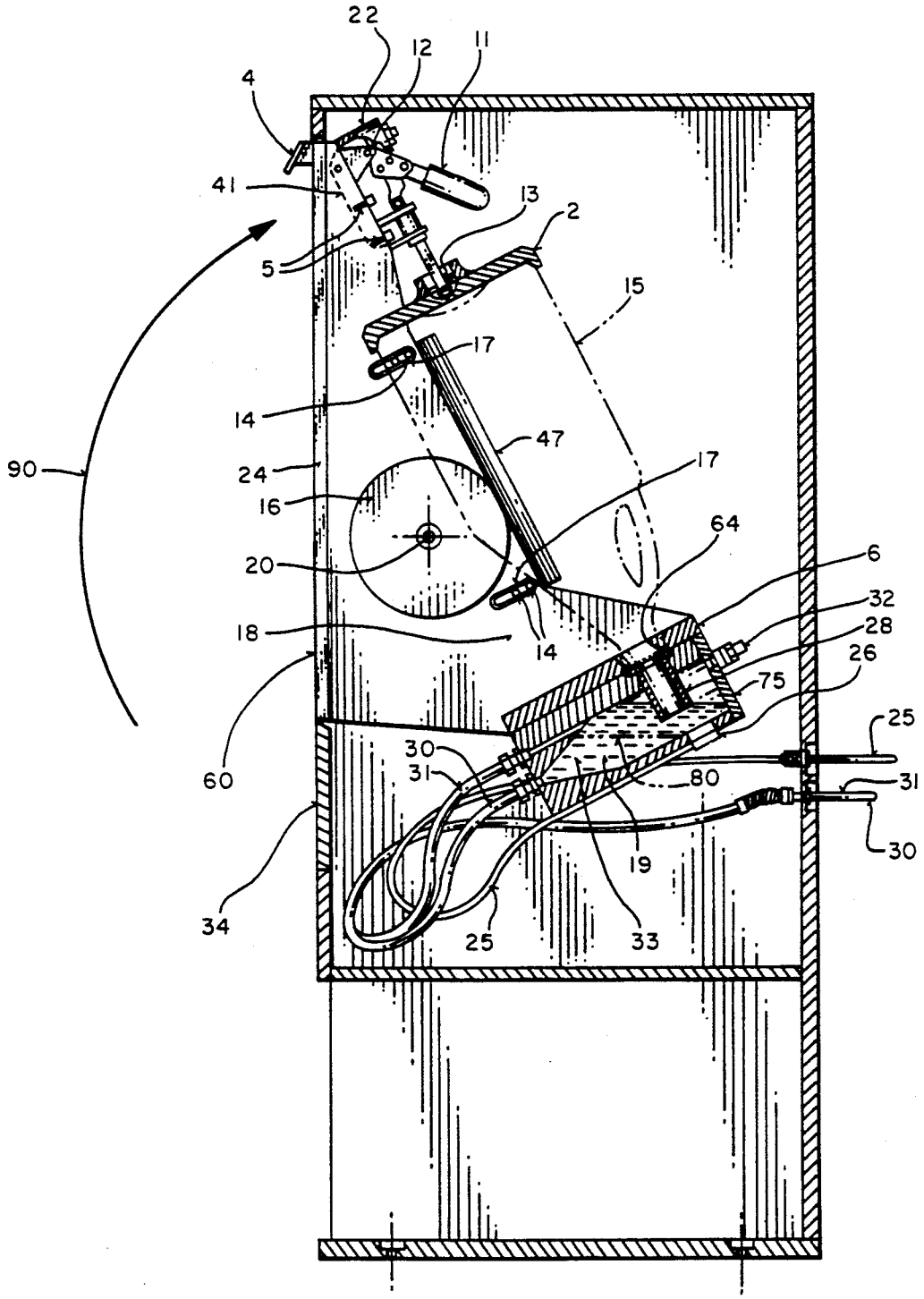
FIG. 2B shows a side cross-sectional view of the liquid delivery apparatus with the bottle cradle in the closed, dispensing position.

In FIG. 2A, liquid delivery apparatus 100 is shown in the open position. Liquid delivery or dispensing system 100 includes a housing 1, a cradle assembly 60 for holding bottle 15, and a liquid dispensing reservoir 19 affixed to the cradle assembly. Cradle assembly 60 is rotatably affixed to housing 1. FIG. 2A illustrates one shape of bottle or container 15 for holding a liquid. In alternative embodiments, bottle 15 can be of alternative shapes and sizes. In a preferred embodiment, reservoir 19 is further affixed to (1) dispensing tube 30 and return tube 31 and (2) sensor line 25. Housing 1 further includes spring stops 22 against which the cradle assembly rests when the liquid dispensing apparatus or system 100 is in its closed position, which is shown in FIG. 2B. The closed position for apparatus 100 is the operating (i.e., dispensing) position. In one embodiment, the liquid can be a solvent, an acid, or a photoresist used in semiconductor processing. In an alternative embodiment, the liquid can be of another type.

As shown in FIG. 2A, cradle assembly 60 is rotatably affixed to axis 20. Axis 20 is in turn affixed to housing 1 of liquid dispensing system 100.

Figure 3:
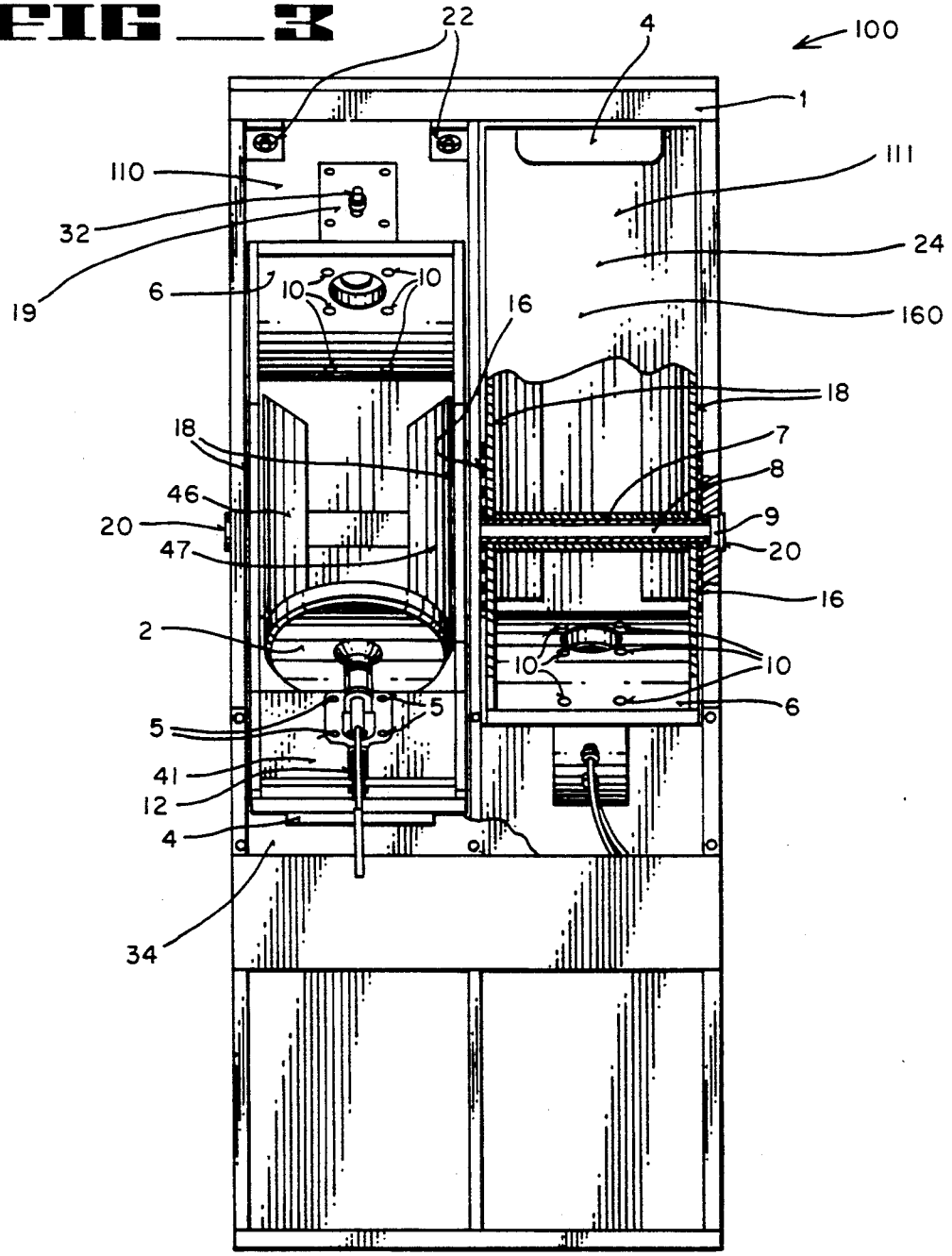
FIG. 3 shows a front cutaway view of the liquid delivery apparatus.

As shown in FIGS. 2A, 2B, and 3, cradle 60 includes two bottle guides 46 and 47. The bottle guides 46 and 47 are angled inward in a preferred embodiment to form a support for container 15. In an alternative embodiment, however, another type of bottle guide may be used.

Platform 2 shown in FIGS. 2A and 2B provides a support at the bottom of bottle 15 to hold bottle 15 in place in cradle 60. Platform 2 is coupled to clamp 12 by a pivoting coupling mechanism 13. Pivoting coupling mechanism 13 helps to provide even force on the bottom of bottle 15. Platform 2, clamp 12, and coupling mechanism 13 also help to provide even force at mouth 64 of bottle 15 and help to ensure a good seal when bottle 15 is forced against seal 27 of reservoir 19. Coupling mechanism 13 is a ball joint mechanism in a preferred embodiment. In an alternative embodiment, coupling mechanism 13 comprises alternative coupling means suitable to couple clamp 12 to the base platform 2.

Clamp 12 is locked into place by rotating lever arm 11. Lever arm 11 is rotated in direction 61 in order to lock bottle 15 into cradle assembly 60. Lever arm 11 is rotated in direction 62 in order to release bottle 15 from cradle assembly 60.

As shown in FIGS. 2A, 2B, and 3, screws 5 couple clamp 12 to base panel 41. Base panel 41 is situated at an angle in cradle 60. As shown in FIGS. 2A and 2B, base panel 41 and handle 4 are affixed to cradle door 24, which is further affixed to walls 18 of cradle assembly 60.

FIG. 3 illustrates a front view of liquid dispensing apparatus 100. In one preferred embodiment, liquid dispensing apparatus comprises two cradle assemblies 60 and 160 in cabinet 1. Cradle assembly 60 is shown in the open position and cradle assembly 160 is shown in the closed position. At side 110 of liquid dispensing apparatus 100, cradle assembly 60 is in an open position. At side 111 of liquid dispensing apparatus 100, cradle assembly 160 is in a closed position, which is the dispensing (i.e., "operating") position.

As shown in FIG. 3, cradle walls 18 are coupled to housing 1 using two bearings 7, axle 8, shaft retainer 9, and bushing 20. Nylon washers 16 shown in FIGS. 2A, 2B, and 3 lie between cradle walls 18 and housing 1.

As shown in FIGS. 2A and 2B, bottle guides 46 and 47 are coupled to side panels 18 using screws 14 and dowel pins 17. Bottle guides 46 and 47 are adjustable up and down using screws 14 and dowel pins 17. Bottle guides 46 and 47 allow cradle 60 to accommodate various bottle diameters. Bottle guides 46 and 47 guide mouth 64 of bottle 15 so that mouth 64 contacts seal ring 27. A seal is created as bottle 15 is pushed against reservoir 19 when handle 11 is locked into position 90.

Reservoir support 6 is coupled to side panels 18. As shown in FIG. 3, reservoir 19 is coupled to reservoir support 6 using screws 10. Reservoir 19 is held at an angle with respect to side panels 18 using support 6, allowing liquids in bottle 15 to be delivered at all times through delivery tube 30, even when (1) bottle 15 is rotated or (2) cradle assembly 60 is in the positions shown in FIGS. 2A and 2B. Thus there is a continuous flow of liquid in reservoir 19 even when bottle 15 is replaced. Because liquids such as photoresist or etch are continuously flowing through reservoir 19, residue build-up is minimized given that the liquids are flowing and not given an opportunity to dry and crystallize. In addition, the conical shape of reservoir 19 together with its position at an angle minimizes areas where residue can build up.

Bottle 15 is secured against reservoir 19 when clamp 12 is placed into position 90. As handle 11 and clamp 12 are moved and secured into position 90, mouth 64 of bottle 15 is pressed against seal ring 27 of reservoir 19 and a seal is created. Plunger clamp 12 is self-locking, which keeps bottle 15 forced against seal ring 27.

In one preferred embodiment, plunger clamp 12 provides a system for applying equal force to any bottle 15 that is loaded into dispensing apparatus 100. Platform 2 pivots on coupling mechanism 13. This helps to compensate for irregularities in bottle 15, such as an uneven base. This helps to ensure a tight seal around mouth 64 when mouth 64 is forced against seal ring 27. Base 2 of system 100 may be interchanged with other bases of various widths and diameters. Thus various sizes of bottles may be used in apparatus 100.

Handle 4 is provided for opening cradle assembly 60 from housing 1. The open position (shown in FIG. 2A) is used for replacing or changing bottle 15. As shown in FIG. 2A, when cradle assembly 60 is fully open, cradle assembly 60 rests against panel 34.

Rotation of cradle assembly 60 is performed after bottle 15 has been locked into place and the dispensing of liquids is to be resumed. Cradle assembly 60 is rotated in direction 90 shown in FIG. 2B so that cradle assembly 60 is in the upright and operating position. Rotation of cradle assembly 60 is halted by spring stops 22.

Cradle assembly 60 is balanced in such a manner around axis 20 such that cradle assembly 60 remains in the open position shown in FIG. 2A using its own weight. No counterweights or locking mechanisms are required to hold cradle assembly 60 in the closed (i.e., operating) position shown in FIG. 2B. Counterweights, springs, cylinders, locking mechanisms, or other securing means may be used to hold cradle assembly 60 in the open and closed positions in alternative embodiments. Nevertheless, lack of these counterweights, springs, etc. reduces the complexity of apparatus 100.

When bottle 15 has been clamped and cradle assembly 60 has been rotated into the closed position (shown in FIG. 2B), the liquid in bottle 15 flows from bottle 15 into reservoir 19. Sensor 26 detects when the liquid in bottle 15 has been depleted. When the level of liquid in reservoir 19 reaches point 80 (shown in FIG. 2B), this information is relayed through sensor probe line 25. A light, an alarm, or other apparatus (not shown) that is coupled to sensor probe line 25 then alerts an attending operator. Level 80 and the location of sensor 26 are chosen to (1) allow a warning signal to be sent to the operator before all the liquid in reservoir 19 has been depleted and (2) give the operator ample time to change bottle 15 in cradle assembly 60 before all the liquid in reservoir 19 has been depleted. In alternative embodiments, levels other than level 80 can be used as the minimum liquid level.

As shown in FIG. 2B, when cradle assembly 60 is in the closed position, liquid from bottle 15 flows into conical passageway 33 of reservoir 19. The liquid in conical passageway 33 then flows into delivery tube 30. Delivery tube 30 and return tube 31 both are coupled to a positive displacement pump (not shown) that lies outside of liquid delivery apparatus 100. The pump can be, for example, deliver etch or photoresist to an awaiting wafer in a semiconductor manufacturing process.

When delivery tube 30 and return tube 31 pass through housing 1, those tubes both lie in the horizontal plane. Therefore, in FIGS. 2A and 2B only delivery tube 30 is visible at the point where the tubes pass through housing 1.

Delivery line 30 provides liquid to the positive displacement pump. The positive displacement pump dispenses liquid stroke by stroke. The pump both compresses and decompresses the liquid. When the liquid is decompressed, bubbles are typically released. The bubbles and typically some liquid pass through a check valve on the pump and into return tube 31 coupled to the check valve of the pump. Return tube 31 thus provides a path for the bubbles to escape from the pump. This helps to keep bubbles out of the liquid dispensed by the pump.

Having a continuous return tube 31 between the pump and reservoir 19 makes the system a closed system, which helps to prevent loss of the liquid that escapes the pump and helps to keep atmospheric contaminants out of the liquid.

In an alternative embodiment, a pump other than a positive displacement pump can be used.

In yet another alternative embodiment, gravity flow is used to dispense a liquid flowing out of delivery tube 30 and no pump is used. In that gravity flow system, no return line 31 is used.

Figure 4:
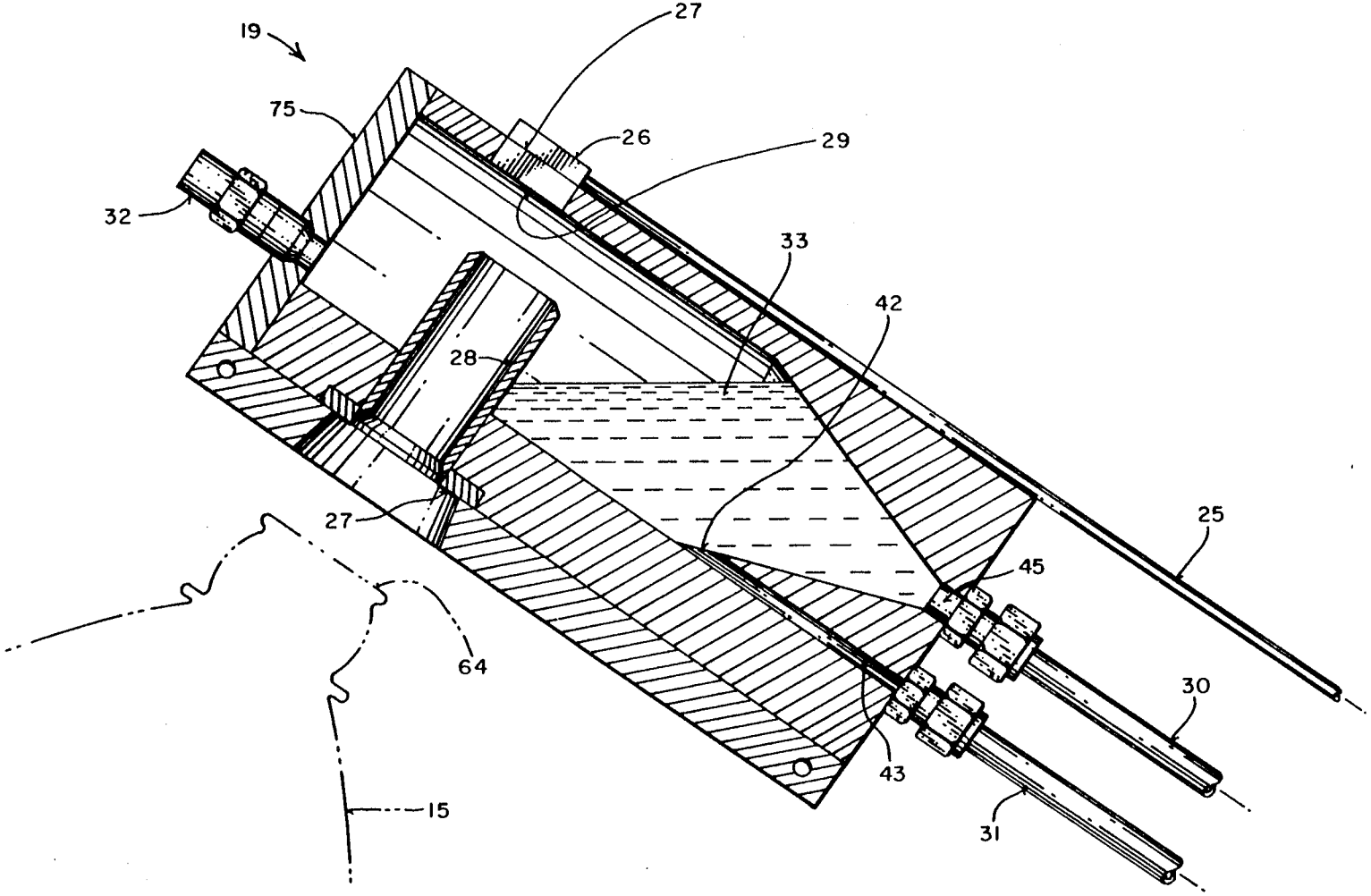
FIG. 4 shows a cross section of the reservoir of the liquid delivery apparatus.

FIG. 4 shows reservoir 19 of one preferred embodiment. The walls of reservoir 19 are constructed of plastic. Reservoir 19 includes passageway 33. Reservoir 19 and passageway 33 are angled from the horizontal (i.e., a horizontal plane) such that the liquid within passageway 33 is able to flow downward to delivery tube entrance 45 when cradle assembly 60 is in the open position, in the closed position, or at any position in between. Moreover, passageway 33 is conically shaped at the bottom. This conical shape helps to minimize residue formation within passageway 33.

In FIG. 4, reservoir 19 is in the position assumed when cradle assembly 60 is in the open position (of FIG. 2A). Return tube 31 has a small cylindrical passageway 43 with an angled opening 42 into conical passageway 33. Return tube 31 provides a means from which the bubbles can escape. When cradle assembly 60 is in the dispensing position (shown in FIG. 2B), return tube opening 42 is located above (relative to the earth) delivery tube entrance 45 and is spaced at a distance shown in FIG. 4 from delivery tube entrance 45. Because bubbles in the liquid are of a lower density than the liquid, the bubbles that escape from the return tube opening 45 rise through the liquid towards the surface of the liquid. When liquid is flowing out of reservoir 19 in the dispensing position, return tube opening 42 and passageway 43 allow air bubbles escaping from return tube 31 to rise to the surface and not enter delivery tube entrance 45, which is lower than return tube opening 42. The result in the dispensing position is that few if any air bubbles from return tube 31 pass into delivery tube 30 while liquid is flowing through delivery tube 30.

When cradle assembly 60 is rotated into the open position (shown in FIG. 2A), return tube opening 42 is still higher (relative to the earth) than delivery tube entrance 45 (and, of course, still spaced at a distance from delivery tube entrance 45). Therefore, in the open position, liquid flows into delivery tube 30 and air bubbles escaping from return tube 31 rise to the surface of the liquid. In the open position, few if any air bubbles pass from return tube 31 into delivery tube 30 while liquid is flowing through delivery tube 30.

One-way check valve 32 is coupled to wall 75 of reservoir 19 opposite delivery and return tubes 30 and 31. Check value 32 allows air to enter reservoir 19 and the air displaces the liquid flowing out of bottle 15. When cradle assembly 60 is placed into the dispensing position, air flows into reservoir 19 through check valve 32 and then into bottle 15. Air flowing through check valve 32 and into bottle 15 equalizes the pressure in bottle 15. Check valve 32 also prevents gases generated from the liquids from leaving reservoir 19. This reduces liquid loss due to evaporation. A filter may be placed in check valve 32 in an alternative embodiment to impede outside contaminants from entering reservoir 19.

In one preferred embodiment, sensor 26 is an Omron capacitive sensor part number E2K-F10MC sold by Omron Electronics, Inc. of Schaumberg, Ill. Capacitive sensor 26 senses the presence or absence of metallic and non-metallic objects on or near a sensing surface 27 of sensor 26. Sensor 26 is sensitive enough that it can also detect the presence or absence of metallic and non-metallic objects on or near location 29 on the plastic wall of reservoir 19 at an area opposite sensing surface 27. Thus sensor 26 can detect whether liquid is present or absent from location 29. Because sensor 26 is a capacitive sensor, sensor 26 has no mechanical parts extending into chamber 33 of reservoir 19 that might otherwise interfere with the flow of liquid in reservoir 19.

Nevertheless, in an alternative embodiment, a floatation device in conjunction with a switch could be used in place of sensor 26 in order to detect the presence or absence of liquid at location 29.

In a preferred embodiment, when cradle assembly 60 is in the dispensing position, sensor 26 detects when the liquid level in reservoir 19 falls below level 80. Sensor 26 sends a signal over line 25 to an appropriate indicator, such as a light or an audio alarm, to indicate that the liquid level is below level 80. This indicates to an attendant that bottle changing is required. Cradle assembly 60 is then rotated in direction 70 and returned to its open position (shown in FIG. 2A) for bottle replacement. The spilling or backflowing into bottle 15 of any chemicals remaining in reservoir 19 is minimized by the fact that cylinder 28 extends into reservoir 19. The location shown in FIG. 4 of sensor 26 helps to ensure that the chemicals remaining in the level sensor chamber 19 will not flow over the top of cylinder 28 within an allowable safety margin once cradle assembly 60 is rotated from the dispensing position (with the liquid level below level 80) to the open position. This helps to prevent backflow or spill.

When bottle 15 is being replaced (and, accordingly, cradle assembly 60 is in the open position), the chemicals remaining in reservoir 19 can continue to flow out through line 30. In that open position (shown in FIG. 2A), air bubbles escaping from return tube 31 rise to the surface of the liquid and generally not into delivery tube 30. When cradle assembly 60 is in the open position, reservoir 19 is angled such that the level of any liquid in reservoir 19 is above opening 45 of delivery tube 30. This allows liquid to be available at all times through delivery tube 30 as long as reservoir 19 has not run dry. Thus, liquid can be dispensed while cradle assembly 60 is in the open position, in the closed position, or at an intermediate point between open and closed positions. This continuous flow of liquid reduces the potential for residue build-up.

To change bottle 15, cradle assembly 60 is rotated in direction 70 (shown in FIG. 2A) from the closed position to the open position. Clamp 12 is released by retracting clamp lever arm 11 in direction 62. This releases the force exerted against bottle 15. This causes bottle 15 to drop down from seal ring 27 of reservoir 19. Empty bottle 15 is removed and replaced with a new full bottle 15 that is placed between guides 46 and 47. Clamp lever arm 11 is rotated in direction 61 to position 90 to force new bottle 15 into position. Mouth 64 of new bottle 15 is thereby pressed against seal ring 27 of reservoir 19. The cradle assembly 60 is then rotated in direction 90 (shown in FIG. 2B) into the inverted or closed position. The dispensing of liquids may thus continue uninterrupted.

In one preferred embodiment, dispensing apparatus 100 is primarily constructed of welded plastic. In alternative embodiments, other materials, such as stainless steel, may be used.

In the foregoing specification, the present invention has been described with reference to specific embodiments thereof. It will, however, be evident that various modifications and changes may be made thereto without departing from the broader spirit and scope of the present invention as set forth in the appended claims. The specification and drawings are, accordingly, to be regarded in illustrative rather than a restrictive sense.

What is claimed is:

1. An apparatus for delivery of a liquid, comprising:

(a) a housing;

(b) a cradle for holding a container containing the liquid, wherein the cradle is rotatably coupled to the housing, wherein the cradle is rotatable between a first position and a second position;

(c) a reservoir for receiving the liquid from the container, wherein the reservoir is coupled to the cradle and rotates with the cradle, and wherein the reservoir includes:

(1) a passageway through the reservoir through which the liquid is able to flow downward for all positions between the first and second positions, inclusive, that the cradle is permitted to rotate to;

(2) a means for minimizing back flow of the liquid from the reservoir to the container;

(3) a first orifice for allowing the liquid to pass out of the reservoir;

(4) a second orifice for allowing an air bubble in the liquid to return to the reservoir, wherein the second orifice is at a location higher relative to the first orifice for all positions that the cradle is permitted to rotate to; and (5) a check valve for allowing air to pass into the reservoir when the liquid flows through the passageway into the first orifice.

2. The apparatus of claim 1 for delivery of a liquid, further comprising a delivery tube coupled to the first orifice and a return tube coupled to the second orifice.

3. The apparatus of claim 1 for delivery of a liquid, wherein the reservoir further includes a level sensor for sensing whether a level of the liquid reaches a first level in the reservoir.

4. The apparatus of claim 3 for delivery of a liquid, wherein the level sensor comprises a capacitive sensor for detecting a presence and an absence of the liquid at a first location within the passageway of the reservoir, wherein the sensor resides outside the passageway.

5. The apparatus of claim 1 for delivery of a liquid, wherein the check valve includes a filter for filtering air entering the reservoir.

6. The apparatus of claim 1 for delivery of a liquid, wherein the passageway is angled from a horizontal plane for all positions the cradle is permitted to rotate to.

7. The apparatus of claim 1 for delivery of a liquid, wherein a bottom of the passageway is conically shaped for minimizing locations where residue of the liquid may accumulate.

8. The apparatus of claim 1 for delivery of a liquid, wherein no tube extends from the reservoir into the container.

9. The apparatus of claim 1 for delivery of a liquid, wherein the cradle includes a container guide for aligning the container with respect to the reservoir, the container guide being adjustable for varying container widths.

10. The apparatus of claim 1 for delivery of a liquid, wherein the rotation of the cradle between the first position and second position is limited by a first stop and a second stop, wherein the first stop is coupled to the housing at the first position and the second stop is coupled to the housing at the second position.

11. The apparatus of claim 1 for delivery of a liquid, wherein the reservoir includes a seal ring and the cradle includes a clamp for holding an opening of the container against the seal ring coupled to the reservoir.

12. The apparatus of claim 11 for delivery of a liquid, wherein the cradle includes a base platform for holding a bottom of the container, wherein the clamp presses against the platform.

13. The apparatus of claim 12 for delivery of a liquid, wherein the platform is removable and can be replaced with a second platform having a different width.

14. The apparatus of claim 13 for delivery of a liquid, wherein the platform further comprises a pivoting coupling mechanism for coupling the platform to the clamp.

15. The apparatus of claim 14 for delivery of a liquid, wherein the platform and the clamp are adjustable for containers of various lengths.

16. The apparatus of claim 1 for delivery of a liquid, wherein the means for minimizing back flow of the liquid comprises a cylinder.

* * * * *